US008272075B2

(12) United States Patent
Lee

(10) Patent No.: US 8,272,075 B2
(45) Date of Patent: Sep. 25, 2012

(54) FRAMELESS DIVING MASK

(75) Inventor: Ting-Fu Lee, Taipei (TW)

(73) Assignee: E. Home Outdoors Inc., Yilan County (TW)

( * ) Notice: Subject to any disclaimer, the term of this patent is extended or adjusted under 35 U.S.C. 154(b) by 839 days.

(21) Appl. No.: 11/939,481

(22) Filed: Nov. 13, 2007

(65) Prior Publication Data

US 2009/0119823 A1 May 14, 2009

(30) Foreign Application Priority Data

Mar. 9, 2007 (TW) ..... 96203868 U

(51) Int. Cl.
*A61F 9/02* (2006.01)

(52) U.S. Cl. ..... 2/427; 351/43

(58) Field of Classification Search ..... 2/426–428, 2/445, 446; 351/43
See application file for complete search history.

(56) References Cited

U.S. PATENT DOCUMENTS 4,707,863 A * 11/1987 McNeal ..... 2/436
6,405,384 B1 6/2002 Chiang
6,473,909 B1 11/2002 Chou
7,058,990 B1 * 6/2006 Lan ..... 2/428
7,143,454 B2 * 12/2006 Kawashima et al. ..... 2/440
2005/0120468 A1 * 6/2005 Kawashima et al. ..... 2/444
2006/0107446 A1 * 5/2006 Shiue ..... 2/428

* cited by examiner

*Primary Examiner* — Katherine Moran
(74) *Attorney, Agent, or Firm* — Morris Manning & Martin LLP; Tim Tingkang Xia, Esq.

(57) ABSTRACT

A method for fabricating a frameless diving includes the following steps. First, providing a lens; next, coating an adhesive on an edge of the lens; then, forming a first flexible layer made of a silica gel on the edge of the lens; thereafter, forming a second flexible layer made of another silica gel on the first flexible layer. The first flexible layer has a plurality of protrusions and may enables the lens covered with the first flexible layer to be spaced apart from a high-temperature mold for a proper distance, so as to prevent the first flexible layer from falling off from the lens due to the high temperature when molding the silica gel. The protrusions are exposed out of the second flexible layer, so as to vary the design and shape of the frameless diving mask abundantly.

5 Claims, 11 Drawing Sheets

FRAMELESS DIVING MASK

BACKGROUND

1. Field of the Present Invention

The present invention relates to a diving mask, and more particularly to a frameless diving mask which is covered by two layers made of flexible materials and a method for fabricating the same.

2. Related Art

When people perform underwater activities, they will feel uncomfortable because their eyes are directly in contact with the water. Thus, in order to protect eyes and to see the surrounding environment underwater more clearly, their usually wear diving mask for underwater activities. Categorized by functions, the diving mask can be divided into swimming goggles used in general swimming and diving mask used while scuba diving or skin diving.

Usually, a traditional diving mask is equipped with a large size transparent lens and a flexible facial mask made of silica gel, wherein the large size transparent lens provides user a broad view underwater and the flexible facial mask provides a nice facial coverage and water tightness. Categorized by the structure to assemble the lens to the mask, the diving masks are divided into frameless diving mask and traditional diving mask having a frame.

For example, the diving mask disclosed in U.S. Pat. Nos. 6,405,384 and 6,473,909 are traditional diving masks having a frame. Although a rigid frame provides support to protect the lens, it increases the distance between the lens and the eyes of the user and negatively affects the shape, so that the optical properties and the side view for the eyes may be negatively affected, which may lead to large parallax when use underwater.

In order to improve the optical properties and the field-of-view, a frameless diving mask which has no rigid frame is invented. The mask used to cover the face is directly formed to be combined with the lens of the frameless diving mask, so the distance between the lens and the eyes is shortened, therefore the optical properties is improved and the field-of-view will be better because the obstacle parts of the mask become less. However, because of the difficulty of combining the silica gel to other materials, the frameless diving mask is either opaque (black) or transparent, which is not like the frame diving mask that the trademarks, tags and other stylish designs can be easily printed or added thereon, and thus making the design or shape of the frameless diving mask dull. So, customer's inclination to the goggle may be affected. Later on, a method of enriching the appearance of the frameless diving mask has been proposed, in which two layers of silica gel with different colors are injection-molded twice on the lens to provide color variation. However, there are difficulties that cannot be overcome in the manufacturing process. When the semi-product of the diving mask with the first layer made of silica gel covered thereon is placed in a mold to perform the injection molding of the second layer made of silica gel, the mold is heated to a high temperature and directly contacts the lens and the first layer of silica gel. Therefore, the heat energy is transferred from the high-temperature mold to the lens and the first layer of silica gel. As the lens and the first layer of silica gel have different thermal expansion coefficients, the first layer of silica gel may fall off from the lens during the injection molding of the second layer of silica gel.

SUMMARY

The frameless diving mask in the prior art has improved the optical properties and the field-of-view, but the frameless diving mask in the prior art is difficult to be stylish. Furthermore, the frameless diving mask formed through molding the silica gel twice is likely to be affected by the high-temperature mold during the manufacturing process, and as a result, the first layer of silica gel may fall off. According to the foregoing problem, the object of the present invention is to provide a frameless diving mask and a method for fabricating the same, which can be stylish to add value to it and to arouse the consumer's desire to purchase, and can overcome the problem that the frameless diving mask is affected by the high-temperature mold during the manufacturing process.

In order to achieve the object of the present invention, a frameless diving mask and a method for fabricating the same are provided. The method for fabricating the frameless diving mask includes the following steps. First, at least one lens is provided, and an edge of the lens is roughened by milling or sand-blasting, so as to increase the surface area of the lens edge. Next, an adhesive is coated on the edge of the lens to assist the lens to be combined with other articles, and the lens is placed in a first mold. Next, a first molding process is performed through the first mold to form a first flexible layer on the edge of the lens, and then a plurality of protrusions and a spacing means are formed on the first flexible layer, in which the first molding process may be performed by injection molding or heat-pressing molding. Thereafter, the lens having the first flexible layer is placed in a second mold, and the lens is spaced apart from the second mold for a certain distance through using the spacing means. The spacing means makes the thickness of the first flexible layer greater than that of the lens, and accordingly, the lens is located higher than the second mold, such that the lens does not contact the second mold, so as to prevent the heat energy from being directly transferred from the high-temperature second mold to the lens. Finally, a second molding process is performed to form a second flexible layer on the first flexible layer, and the protrusions of the first flexible layer are exposed out of the second flexible layer, in which the protrusions may increase the contact area between the first flexible layer and the second flexible layer, so as to enhance the combination effect for the first and second flexible layers.

The frameless diving mask fabricated through the fabricating method of the present invention includes at least one lens, a first flexible layer and a second flexible layer. The first flexible layer is covered on an edge of the lens and has a plurality of protrusions, in which the thickness of the first flexible layer is greater than that of the lens. The second flexible layer is directly formed on the first flexible layer and the protrusions of the first flexible layer are exposed out of the second flexible layer. The second flexible layer is formed on part of the first flexible layer or formed on with a specific shape. For example, the second flexible layer forms a facial mask part for users to wear the frameless diving mask and has a different color from that of the first flexible layer. Or the first flexible layer forms a facial mask part for users to wear the frameless diving mask and the second flexible layer becomes a pattern on the first flexible layer to emboss the appearance of the frameless diving mask. In addition, this invention also provides a frameless diving mask having a lens holder for fixing the angle of two lenses to improve the stability of the lens.

The efficacy of the present invention is that the first flexible layer enables the lens not to contact the high-temperature second mold, so as to prevent the lens from being excessively expanded due to being heated, and thus effectively preventing the first flexible layer from falling off from the lens. The protrusions of the first flexible layer not only can enhance the combination effect for the first and second flexible layers, but also can be exposed out of the second flexible layer, and thus abundantly varying the appearance and the color of the frameless diving mask, and effectively adding value to the frameless diving mask and arousing the consumer's desire to purchase.

BRIEF DESCRIPTION OF THE DRAWINGS

The present invention will become more fully understood from the detailed description given below, which is for illustration only and thus is not limitative of the present invention, wherein.

DETAILED DESCRIPTION

Figure 1:
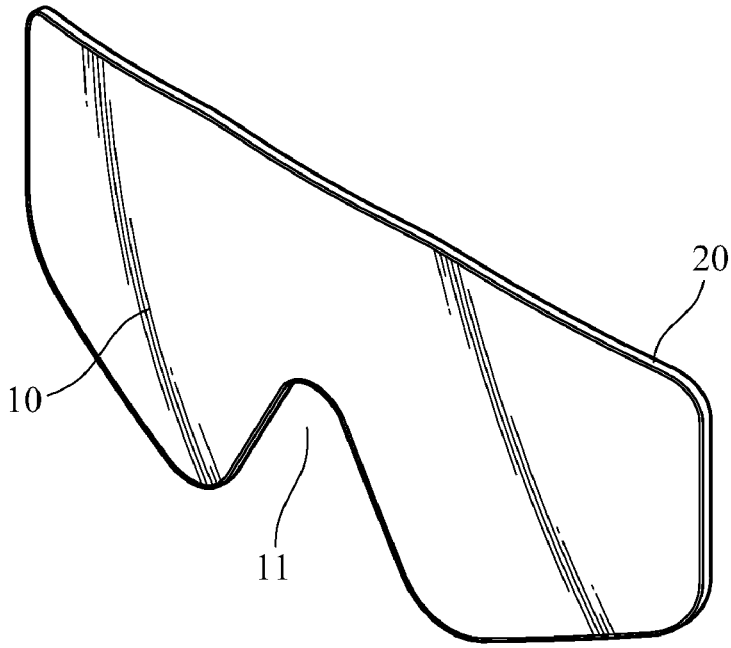
FIG. 1 is a perspective view of the lens of a first embodiment of the present invention.
Figure 2:
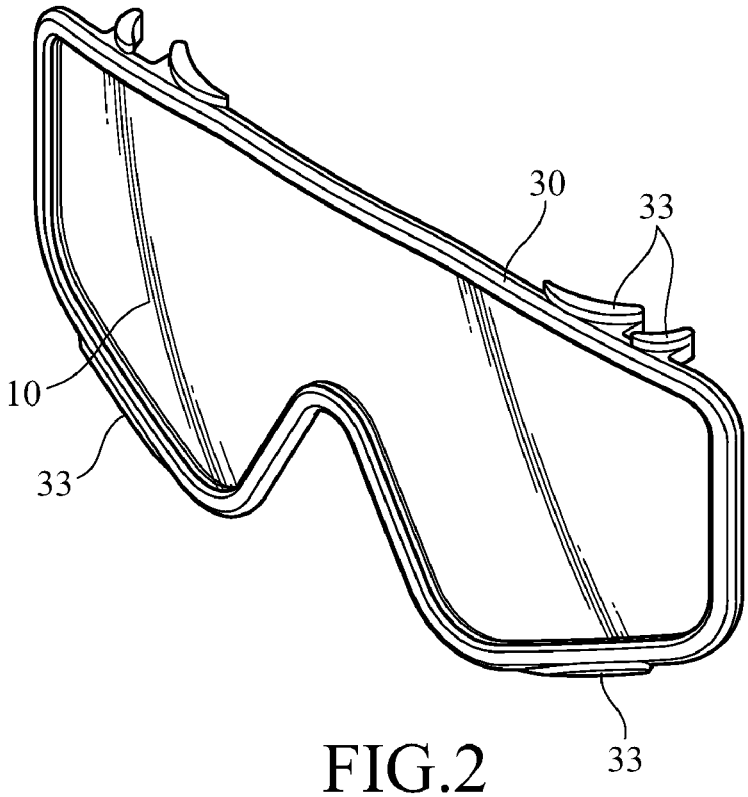
FIG. 2 is a perspective view of the lens with the first flexible layer covering the lens of the first embodiment of the present invention.
Figure 3:
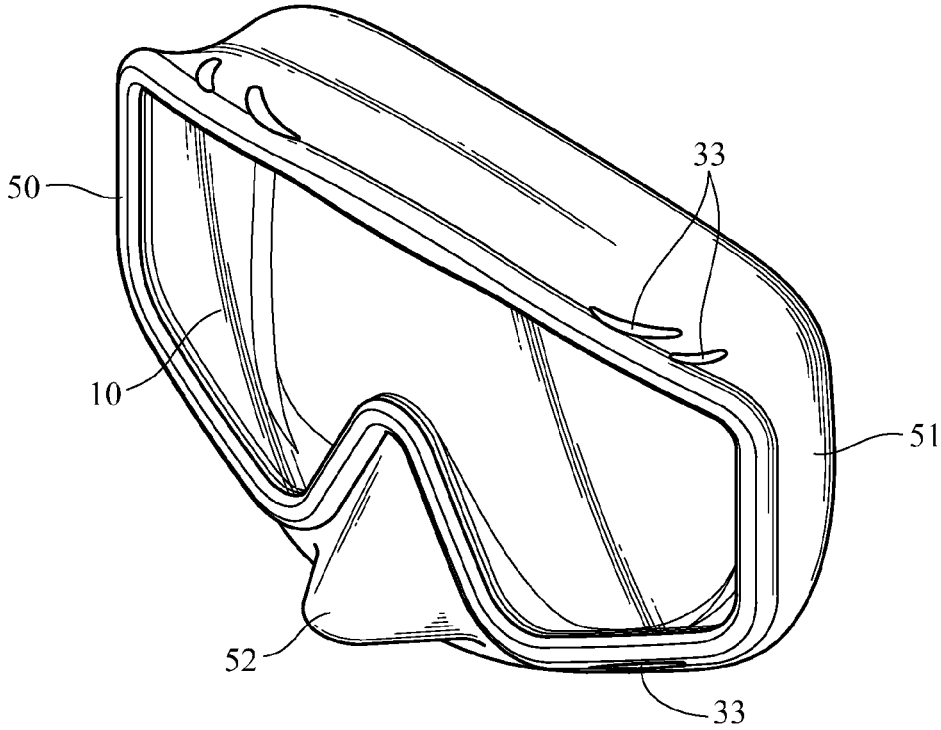
FIG. 3 is a perspective view of the frameless diving mask of the first embodiment according of the present invention.
Figure 4:
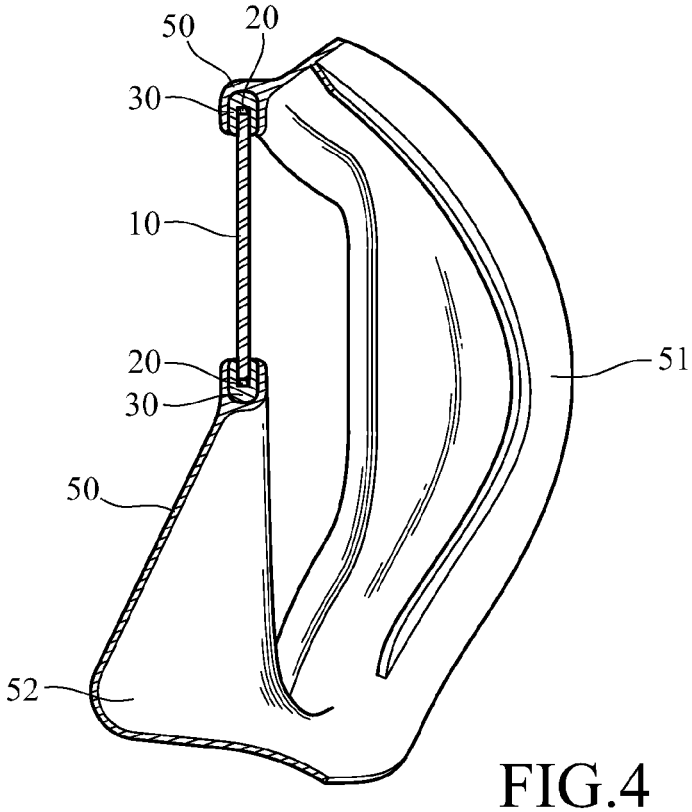
FIG. 4 is a cross-sectional view of the frameless diving mask of the first embodiment of the present invention.

Referring to FIGS. 1, 2, 3 and 4, a frameless diving mask of a first embodiment of the present invention is provided, which is used for divers to wear underwater. The frameless diving mask includes a lens 10, a first flexible layer 30, and a second flexible layer 50.

The material of the lens 10 can be but not limited to a thin tempered glass that has a good transparent property or an industrial plastic material (such as polycarbonate) that has the same transparent property. One side edge of the lens 10 is sunken to form a notch 11 to divide the lens 10 into two symmetrical view areas corresponding to user's eyes. An adhesive 20 is coated on an edge of the lens 10 to be an agent for combining the lens 10 to other components.

The material of the first flexible layer 30 can be but not limited to a silica gel, and preferably thermosetting silica gel or thermoplastic silica gel, and other materials, such as plastics. The first flexible 30 covers the edge of the lens 10. Since the material of the lens 10 is different from that of the first flexible layer 30, the first flexible layer 30 cannot be directly formed to be combined with the lens 10 by injection molding. Accordingly, the adhesive 20 is coated on the edge of the lens 10 to make the first flexible layer 30 be able to combine with the lens 10 after the injection molding, so the first flexible layer 30 is adhered to the edge of the lens 10 to cover the edge of the lens 10. The adhesive 20 also can be mixed with the silica gel which is the same as that of the first flexible layer 30 in advance, and then be directly injection molding formed on the lens 10 with the first flexible layer 30, to make the first flexible layer 30 be covered and adhered to the lens 10. The first flexible layer 30 has a plurality of protrusions 33 thereon, and each protrusion 33 extends from the edge of the lens 10 towards the same side. The thickness of the first flexible layer 30 is greater than that of the lens 10, and the first flexible layer 30 extends from the edge of the lens 10 towards inside. So that, when the lens 10 with the first flexible layer 30 covered thereon is placed on a plane, the lens 10 is located higher due to the existence of the first flexible layer 30 and spaced apart from the plane for a certain distance.

The material of the second flexible layer 50 can be but not limited to silica gel, and preferably thermoplastic silica gel, and other materials, such as plastics. However, the hardness of the second flexible layer 50 is softer than the first flexible layer 30. The second flexible layer 50 is directly injection molded on the first flexible layer 30 to cover and be fixed thereon and the first flexible layer 30 is located between the lens 10 and the second flexible layer 50. Because the material of the second flexible layer 50 is the same as that of the first flexible layer, the second flexible layer 50 can be directly combined with the first flexible layer 30 after the injection molding. A part of the second flexible layer 50 is formed to a nose cover part 52 which is outward projecting at the notch 11 of the lens 10. And the other part of the second flexible layer 50 is also formed surrounding the first flexible layer 30 and extends toward one side of the lens 10 to form a facial mask part 51 at one side of the lens 10, which fits the figure of the face of the user for the user to wear, thus and the facial mask part 51 covers the face tightly with the assistance of the strap to prevent the water entering the space between the lens 10 and the user's face.

Accordingly, the shape and color can be changed by the combination of the first flexible layer 30 and the second flexible layer 50, for example, the protrusions 33 of the first flexible layer 30 are partly exposed out of the second flexible layer 50, so to make it be able to be stylish.

Figure 14:
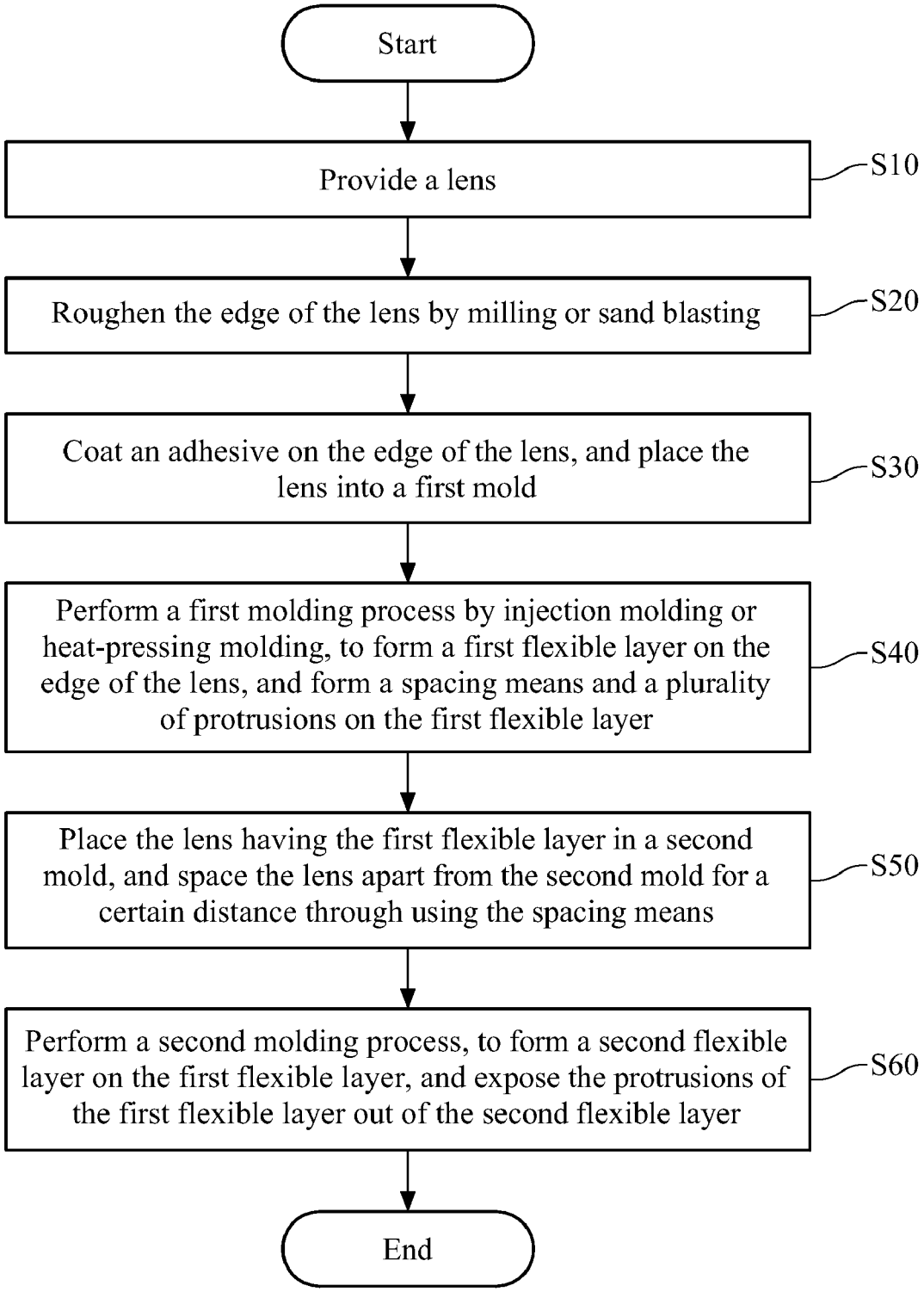
FIG. 14 is a flow chart of the method for fabricating the frameless diving mask according to the first embodiment of the present invention.

Referring to FIG. 14, it shows a method for fabricating a frameless diving mask, which is used to fabricate the frameless mask in the first embodiment and includes the following steps. First, in Step S10, a lens 10 is performed and provided. Next, in Step S20, the edge of the lens 10 is roughened to increase the surface area of the edge of the lens 10. In the present invention, the edge of the lens 10 may be roughened by milling or blasting. Thereafter, in Step S30, the adhesive 20 is coated on the edge of the lens 10 to assist the combination between the lens 10 and the first flexible layer 30, and the lens 10 is placed in a first mold. Then, in Step S40, a first molding process is performed through the first mold to form a first flexible layer 30 on the edge of the lens 10, and protrusions 33 and a spacing means are formed on the first flexible layer 30. The first molding process may be performed by injection molding or heat-pressing molding, and the first flexible layer 30 may be selected to be a thermoplastic silica gel or a thermosetting silica gel. Furthermore, in Step S50, the lens 10 with the first flexible layer 30 covered thereon is placed in a second mold, and the lens 10 is spaced apart from the second mold for a certain distance through using the spacing means. The spacing means makes the thickness of the first flexible layer 30 greater than that of the lens 10, so the lens 10 is located higher than the second mold due to the first flexible layer 30 after the lens 10 is placed in the second mold, such that the lens 10 does not contact the second mold, thereby preventing the heat energy from being directly transferred from the high-temperature second mold to the lens 10. In addition, the spacing means or the protrusions 33 can be used for positioning the lens having the first flexible layer on the second mold. For example, a plurality of fillisters corresponding to the contour of the first flexible layer 30 or the protrusions 33 are opened on the second mold. So, the first flexible layer 30 or the protrusions 33 insert the fillister in order to position the lens having the first flexible layer on the second mold. Finally, in Step S60, a second molding process is performed to form a second flexible layer 50 on the first flexible layer 30, and the protrusions 33 of the first flexible layer 30 are exposed out of the second flexible layer 50. Furthermore, the protrusions 33 may increase the contact area between the first flexible layer 30 and the second flexible layer 50, so as to enhance the combination effect for the first flexible layer 30 and the second flexible layer 50.

Figure 5:
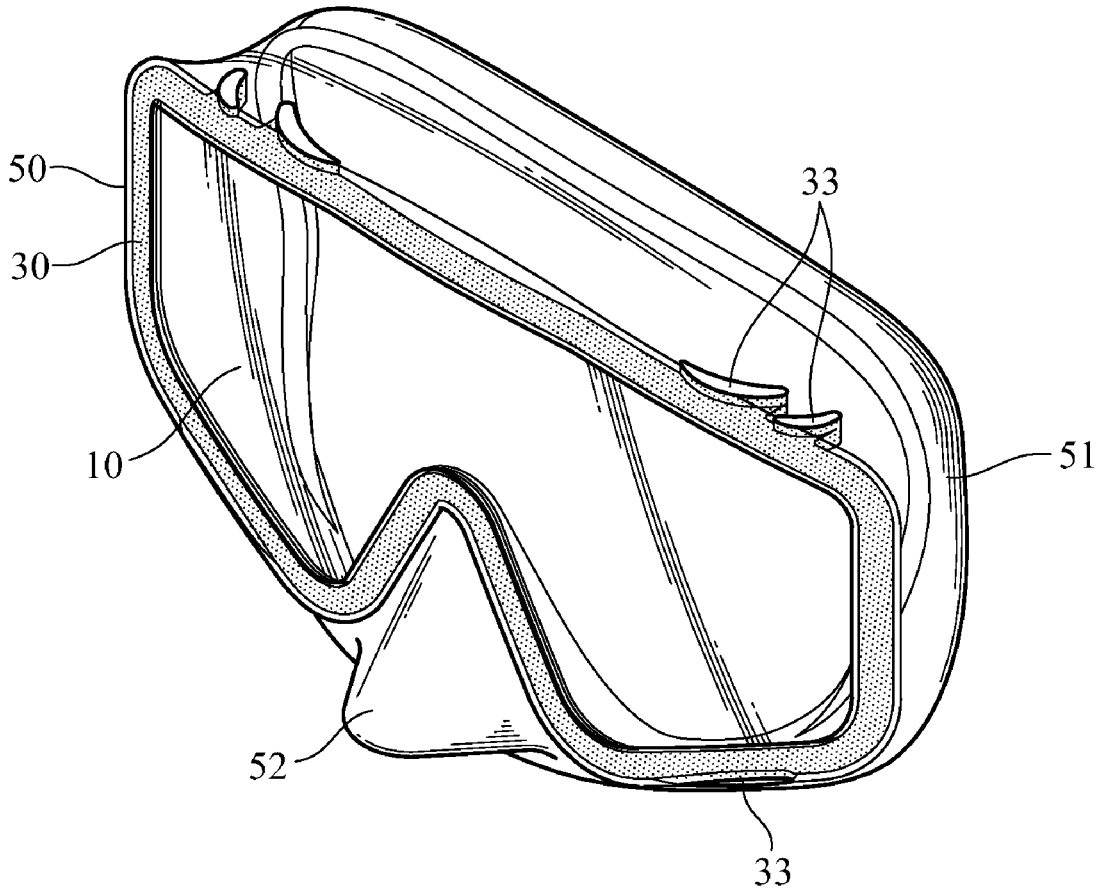
FIG. 5 is a perspective view of a second embodiment of the present invention.

Referring to FIG. 5, a frameless diving mask of a second embodiment of the present invention is provided, wherein the structure and the fabrication method of the second embodiment are the same as the first embodiment. In the second embodiment, the second flexible layer 50 is transparent or opaque, the first flexible layer 30 is made of a transparent silica gel or a silica gel with dyes, so that the color of the second flexible layer 50 is different from that of the first flexible layer 30. In addition, the color of the first flexible layer 30 can be switched with that of the second flexible layer 50. When the second flexible layer 50 is made of transparent silica gel, even if the protrusions 30 of the first flexible layer 30 are totally covered by the second flexible layer 50, they may still expose out of the second flexible layer 50 due to the light transmittance of the second flexible layer 50. Thus, the frameless diving mask has two colors to change the appearance, and the commercial value of frameless diving mask is increased.

Figure 6A:
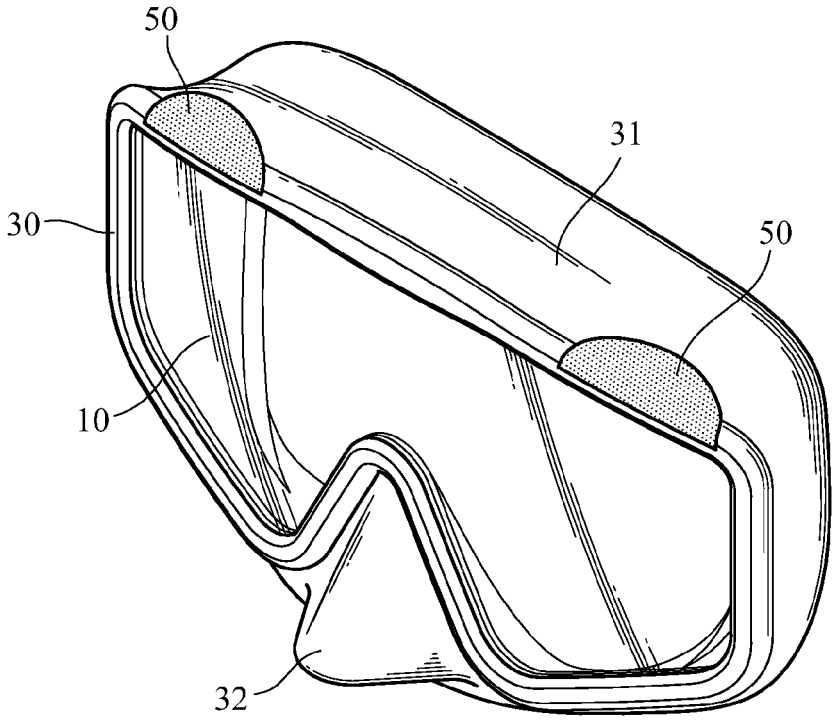
FIG. 6A is a perspective view of a third embodiment of the present invention.
Figure 6B:
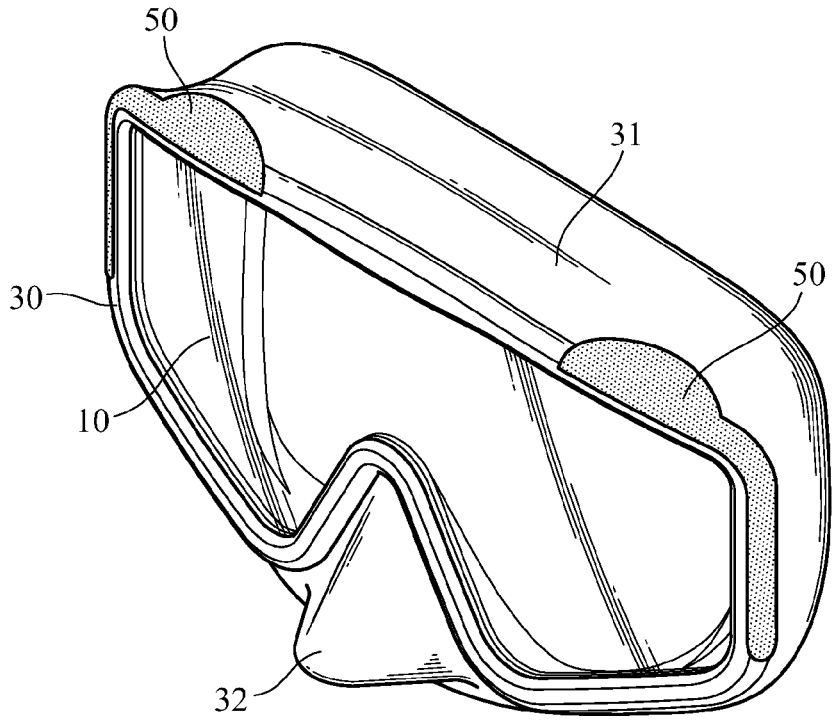
FIG. 6B is a perspective view of the third embodiment of the present invention.
Figure 7:
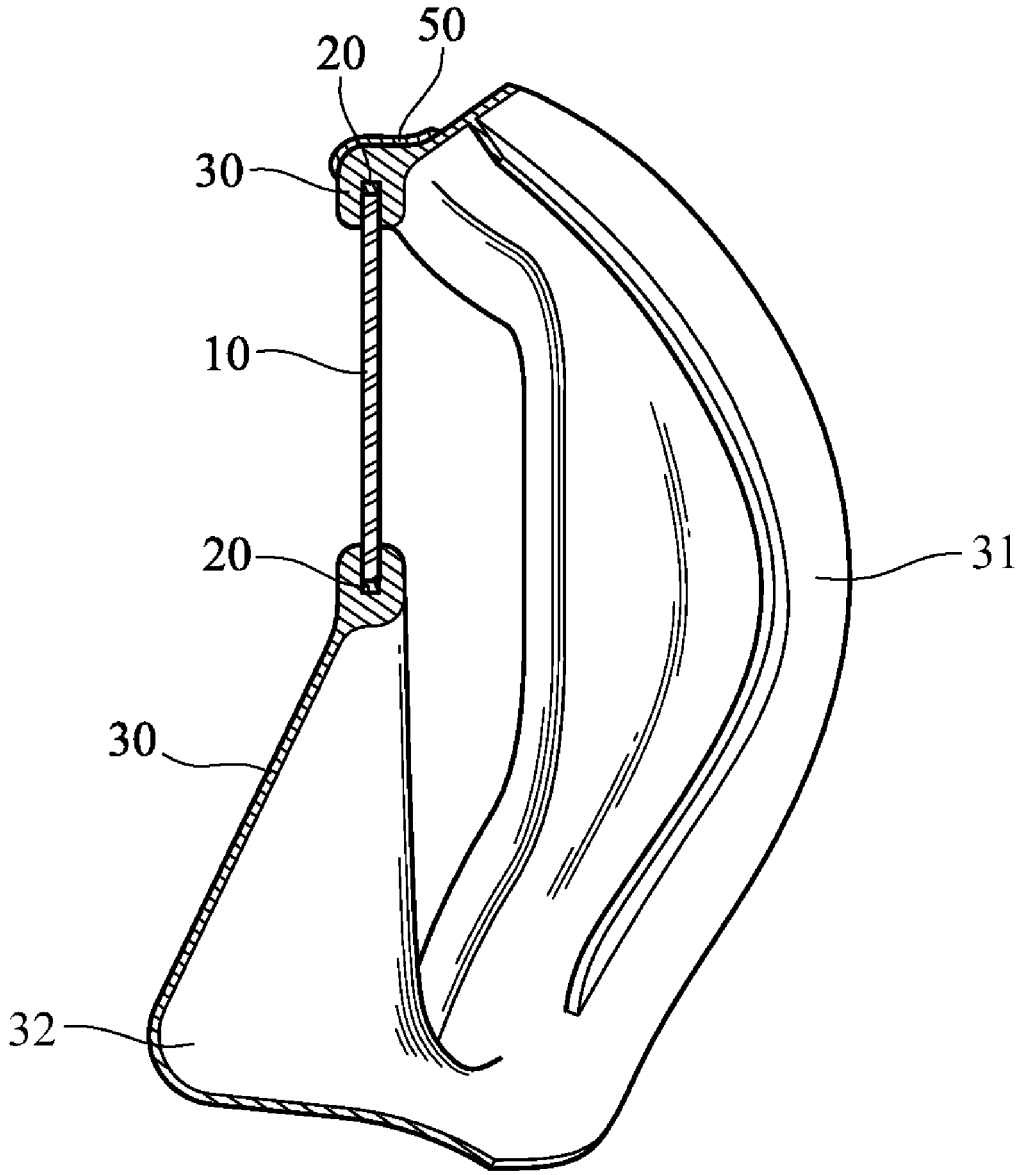
FIG. 7 is a cross-sectional view of the third embodiment of the present invention.

Referring to FIG. 6A, FIG. 6B, and FIG. 7, a frameless diving mask of a third embodiment of the present invention is provided. A part of the first flexible layer 30 is formed to a nose cover part 32 which is outward projecting at the notch 11 of the lens 10. And the other part of the first flexible layer 30 is formed to cover the edge of the lens 10 and extends toward one side of the lens 10 to form a facial mask part 31, which fits the figure of the user's face for the user to wear, thus the facial mask part 31 covers the face tightly with the assistance of the strap. The second flexible layer 50 is formed directly by injection molding with specific shape or on part of the first flexible layer 30, wherein the color of the first flexible layer 30 is different from that of the second flexible layer 50, so as to give the frameless diving mask abundant color and shape changing ability for stylish. Therefore, the commercial value of the frameless diving mask is increased. Here, the design of shape of the present invention is not limited to the foregoing embodiments.

Figure 8:
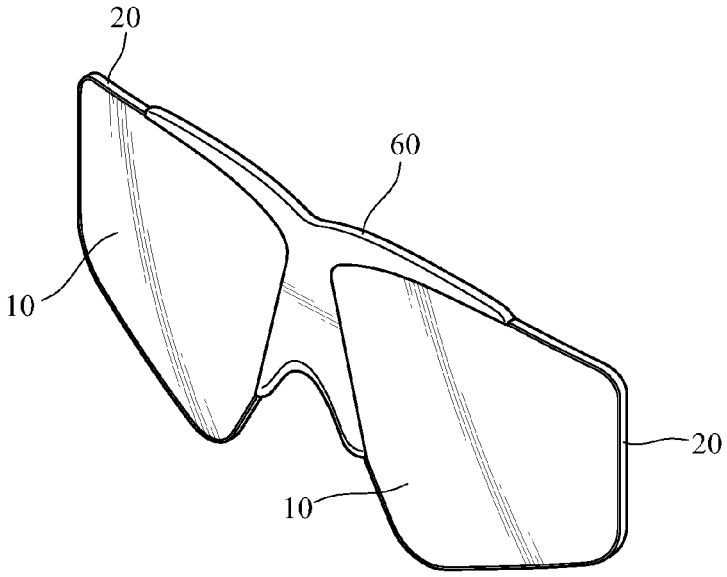
FIG. 8 is a perspective view of two lenses and the lens holder of a fourth embodiment of the present invention.
Figure 9:
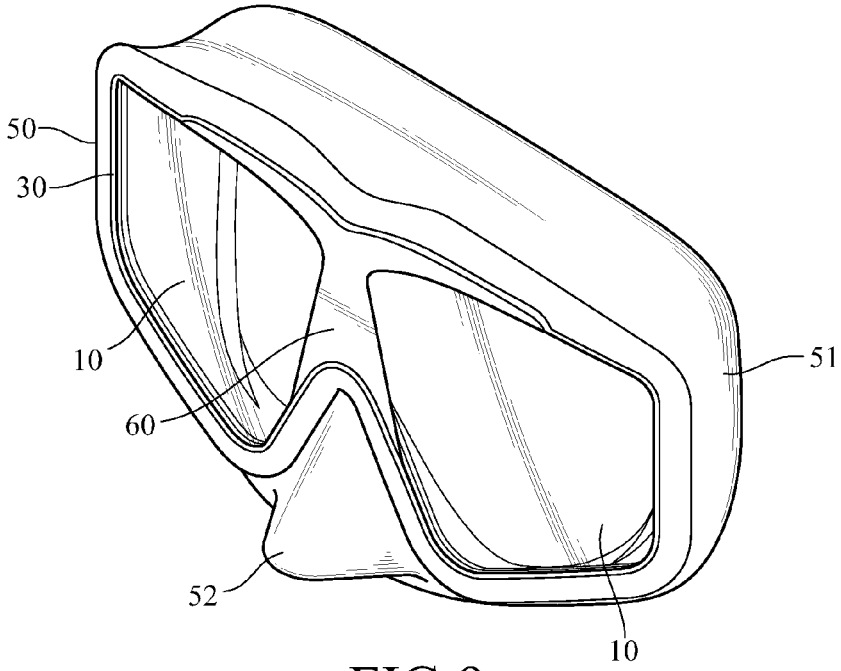
FIG. 9 is a perspective view of the fourth embodiment of the present invention.

Referring to FIGS. 8 and 9, a frameless diving mask of a fourth embodiment of the present invention is provided. The frameless diving mask includes two lenses 10 and a lens holder 60 mounted between the two lenses 10. The adhesive 20 is coated on edges of the lenses 10 and the lens holder 60, so that the first flexible layer 30 formed by injection molding covers and is adhered to the edges of the lenses 10 and the lens holder 60. This embodiment can apply to a frameless diving mask which has two lenses 10 in order to fix the angle between the two lenses 10 and improve the stability of the lenses 10.

Figure 10:
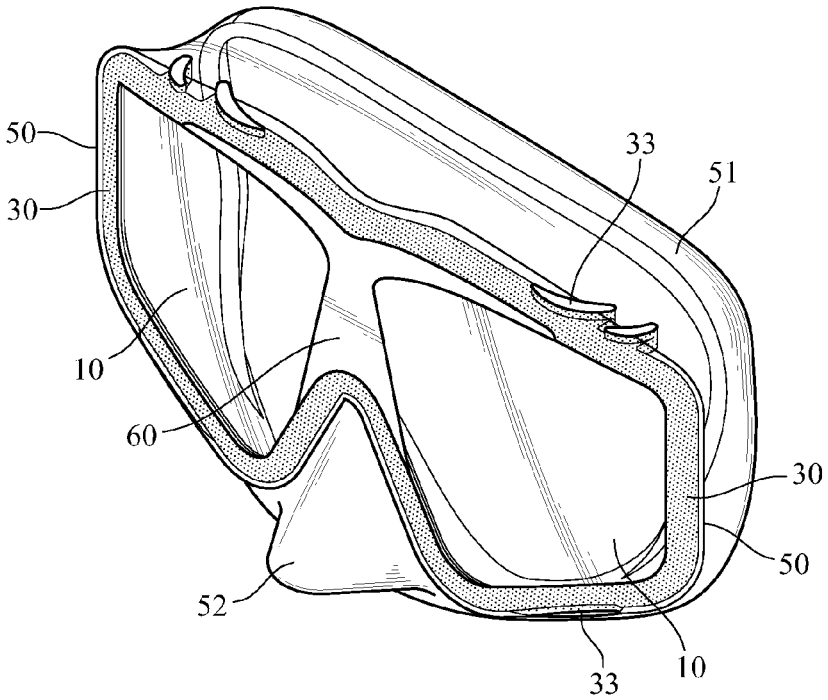
FIG. 10 is a perspective view of a fifth embodiment of the present invention.

Referring to FIG. 10, a frameless diving mask of a fifth embodiment of the present invention is provided, wherein the structure of the fifth embodiment is the same as that of the fourth embodiment. The second flexible layer 50 is made of transparent or opaque silica gel, and the first flexible layer 30 is made by transparent silica gel or silica gel with dyes, so that the color of the first flexible layer 30 can be observed while the second flexible layer 50 is transparent. Thus, the frameless diving mask has two colors to change the appearance, and the commercial value of frameless diving mask is increased.

Figure 15:
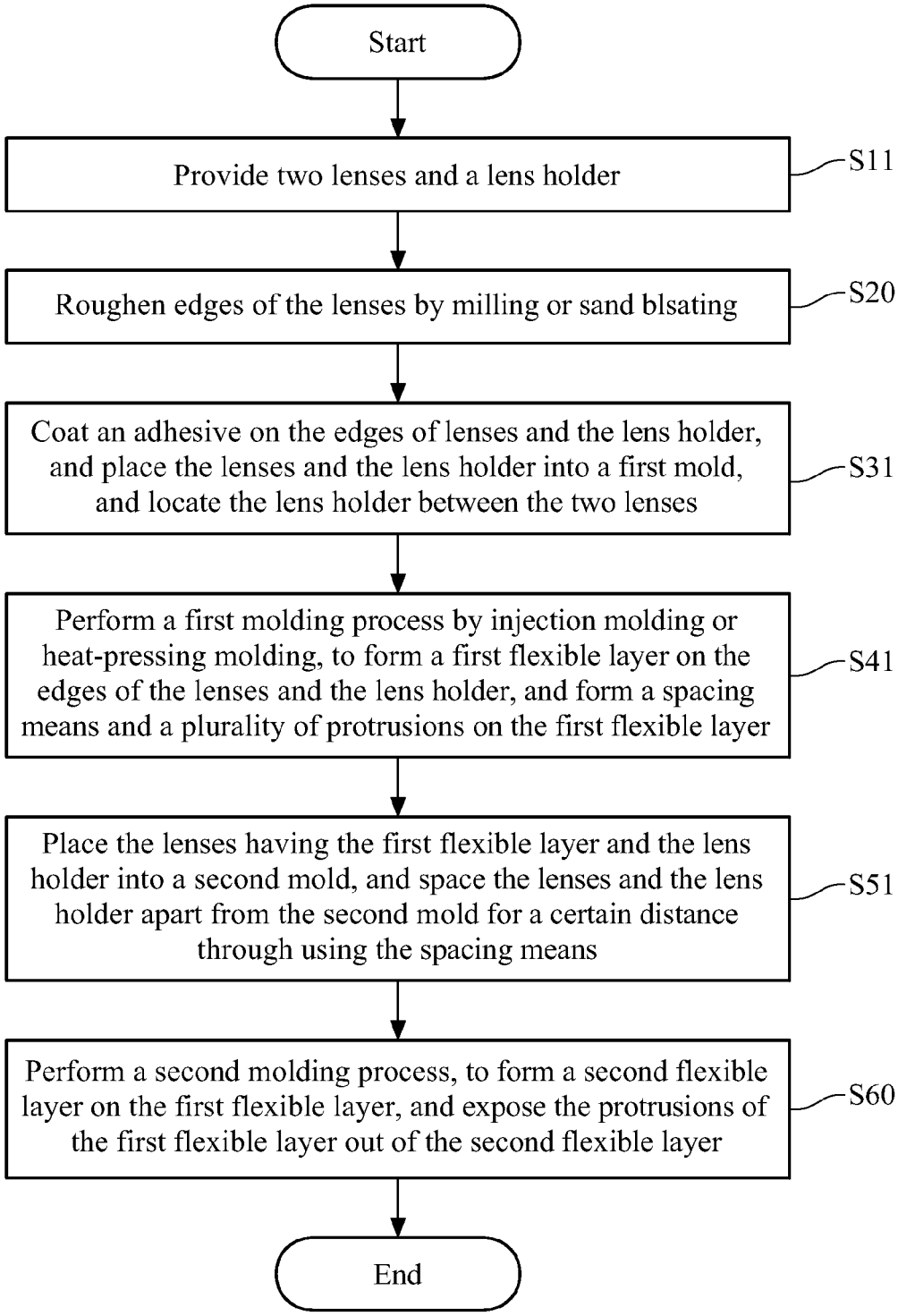
FIG. 15 is a flow chart of the method for fabricating the frameless diving mask according to the fifth embodiment of the present invention.

Referring to FIG. 15, it shows a method for fabricating a frameless diving mask of the present invention, which is used to fabricate the frameless diving mask in the fourth and fifth embodiments and includes the following steps. First, in Step S11, two lenses 10 and a lens holder 60 are performed and provided. Next, in Step S20, edges of the lenses 10 are roughened to increase the surface area for the edges of the lenses 10 and the lens holder 60. In the present invention, the edges of the lenses 10 and the lens holder 60 may be roughened by milling or sand-blasting. Thereafter, in Step S31, an adhesive 20 is coated on the edges of the lenses 10 and the lens holder 60 to assist combining the lenses 10 and the lens holder 60 with the first flexible layer 30. Then, the lenses 10 and the lens holder 60 are placed into a first mold, and the lens holder 60 is located between the two lenses 10. Then, in Step S41, a first molding process is performed through the first mold, so as to form the first flexible layer 30 on the edges of the lenses 10 and the lens holder 60, and protrusions 33 and a spacing means are formed on the first flexible layer 30. The first molding process may be performed by injection molding or heat-pressing molding, and correspondingly, the first flexible 30 is made of thermoplastic silica gel or thermosetting silica gel. Then, in Step S51, the lenses 10 having the first flexible layer 30 and the lens holder 60 are placed into a second mold, and the lenses 10 and the lens holder 60 are spaced from the second mold for a certain distance through using the above spacing means. The spacing means makes the thickness of the first flexible layer 30 greater than that of the lenses 10. Therefore, when the lenses 10 and the lens holder 60 are placed into the second mold, the lenses 10 and the lens holder 60 are located higher than the second mold due to the existence of the first flexible layer 30, and thus the lenses 10 and the lens holder 60 do not contact the second mold, thereby preventing the heat energy from being directly transferred from the high-temperature second mold to the lenses 10. In addition, the spacing means or the protrusions 33 can be used for positioning the lens having the first flexible layer on the second mold. For example, a plurality of fillisters corresponding to the contour of the first flexible layer 30 or the protrusions 33 are opened on the second mold. So, the first flexible layer 30 or the protrusions 33 insert the fillister in order to position the lens having the first flexible layer on the second mold. Finally, in Step S60, a second molding process is performed to form a second flexible layer 50 on the first flexible layer 30, and protrusions 33 of the first flexible layer 30 are exposed out of the second flexible layer 50.

Figure 11:
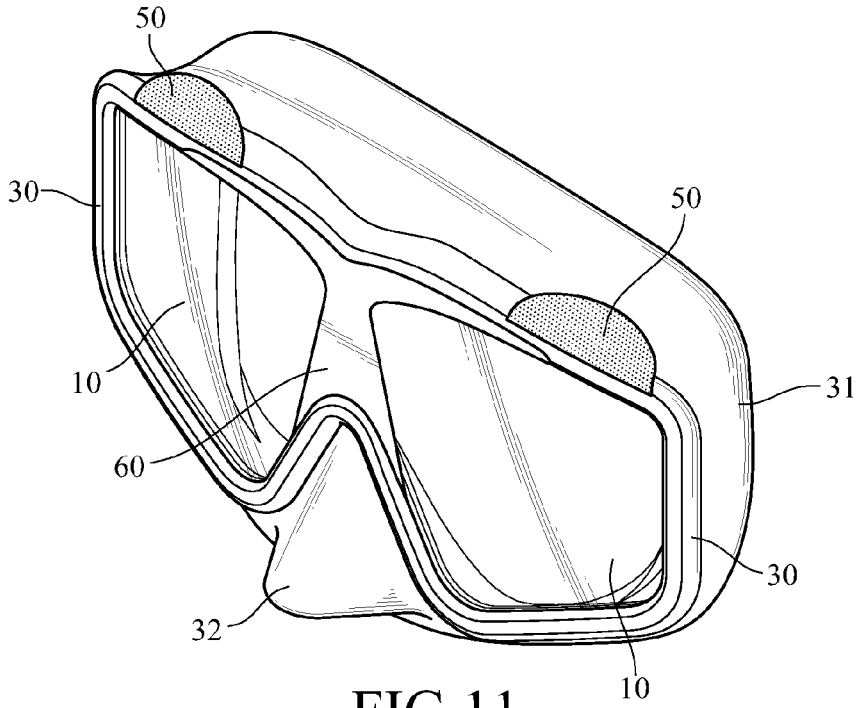
FIG. 11 is a perspective view of a sixth embodiment of the present invention.

Referring to FIG. 11, a frameless diving mask of a sixth embodiment of the present invention is provided, wherein the structure of the sixth embodiment is approximately the same as that of the fourth embodiment. A part of the first flexible layer 30 is formed to a nose cover part 32 which is outward projecting between two lenses 10. And the other part of the first flexible layer 30 is formed cover the edges of the lenses 10 and extends toward one side of the lenses 10 to form a facial mask part 31, which fits the figure of the user's face for the user to wear, thus the facial mask part 31 covers the face tightly with the assistance of the strap. The second flexible layer 50 is formed directly by injection molding on part of the first flexible layer 30, or with specific shape on the first flexible layer 30. The color of the first flexible layer 30 is different from that of the second flexible layer 50, so as to give the frameless diving mask abundant color and shape changing ability for stylish. Therefore, the commercial value of the diving mask is increased. Here, the design of shape of the present invention is not limited to the foregoing embodiments.

Figure 12:
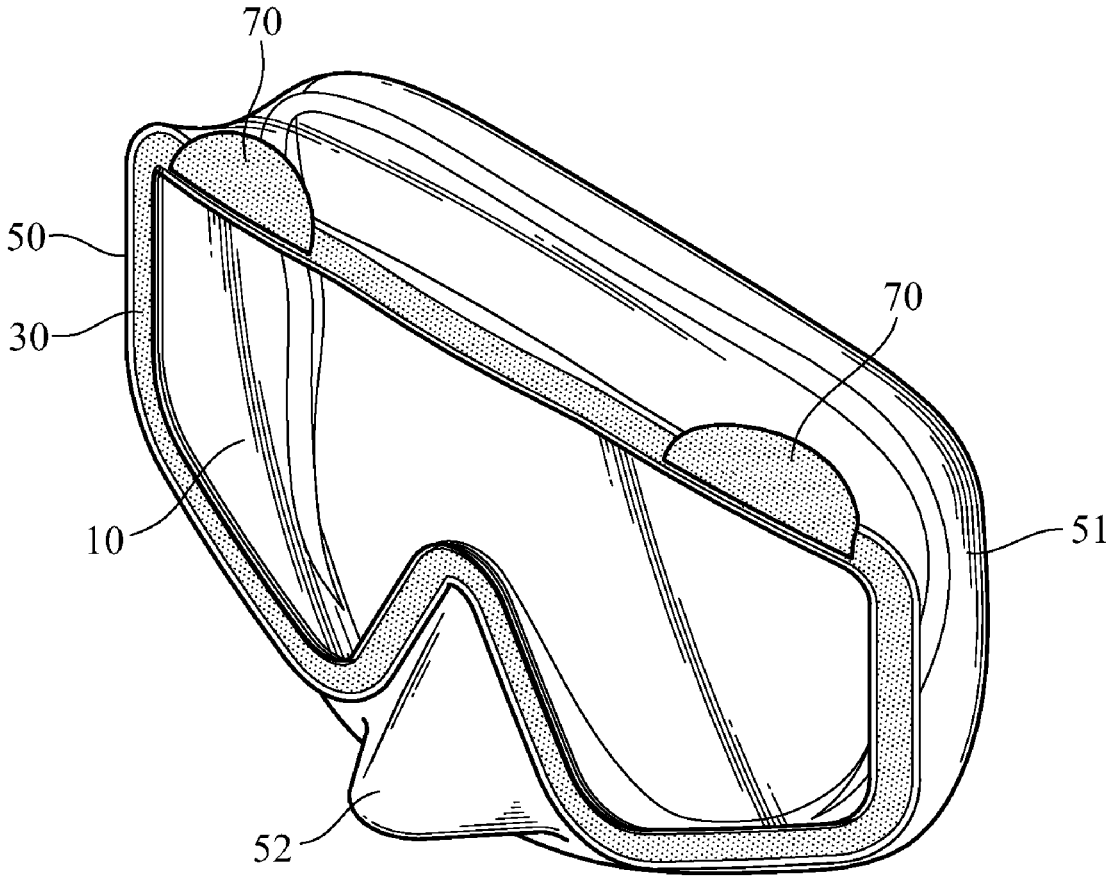
FIG. 12 is a perspective view of a seventh embodiment of the present invention.

Referring to FIG. 12, a frameless diving mask of a seventh embodiment of the present invention is provided. The seventh embodiment further includes a third flexible layer 70, which can be made by but not limited to a silica gel. The third flexible layer 70 is formed on part of the first flexible layer 30 or the second flexible layer 50 directly by injection molding, or formed with specific shape on the first flexible layer 30 or the second flexible layer 50. Here, the third flexible layer 70 is formed on the second flexible layer 50 in this embodiment. The color of the third flexible layer 70 is different from that of the first flexible layer 30 and the second flexible layer 50, so that the diving mask has more variability in colors for users to choose. For example, a diving mask according to the present invention can be specially designed according to the star signs or lucky colors in order to attract the consumer's attention so to increase its market competition ability. Although this embodiment uses three layers of flexible layers as an example, the number of the flexible layers is not limited as long as it is under the concept of the present invention. For example, the present invention also can apply to 4, 5, or 6 layers of flexible layers.

Figure 13:
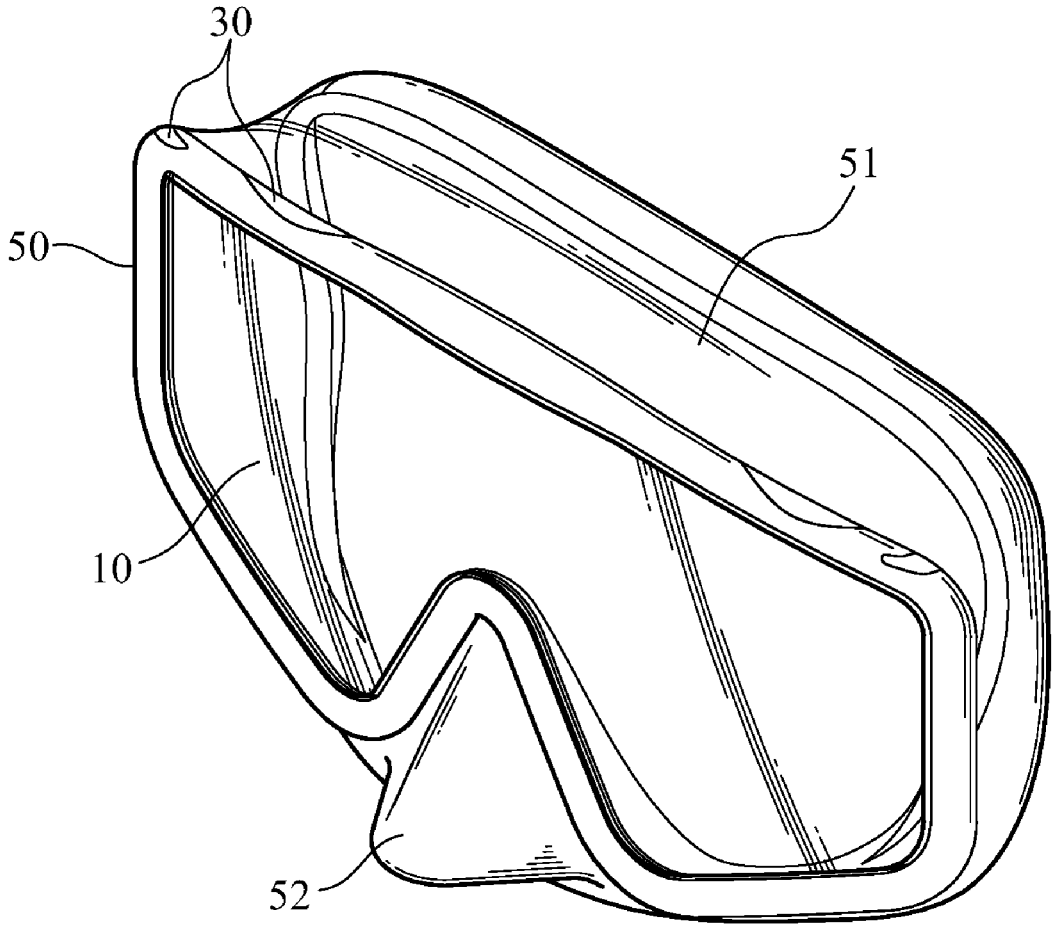
FIG. 13 is a perspective view of an eighth embodiment of the present invention.

Referring to FIG. 13, a frameless diving mask of a eighth embodiment of the present invention is provided, wherein the structure of the eighth is approximately the same as that of the first embodiment. In this embodiment, the second flexible layer 50 is formed on the first flexible layer 30 but does not cover the whole first flexible layer 30, so that part of the first flexible layer 30 exposes. In addition, different colors of dyes can be added into the silica gel for forming the two flexible layers to allow the two flexible layers exhibit different transparent/opaque and dark/light combination. Thus, the commercial value of the diving mask is increased because of its abundant variability in colors.

In the frameless diving mask and the method for fabricating the same according to the present invention, a second flexible layer 50 of silica gel and the first flexible layer 30 are used to cover the lens 10. The first flexible layer 30 enables the lens 10 not to contact the high-temperature second mold, so as to prevent the lens 10 from being excessively expanded due to being heated, and thus effectively preventing the first flexible layer 30 from falling off from the lens 10. The protrusions 33 of the first flexible layer 30 not only can enhance the combination effect between the first flexible layer 30 and the second flexible layer 50, but also can be exposed out of the second flexible layer 50, so as to provide a frameless diving mask with abundant variability in design and color, and to effectively add value to the frameless diving mask and to arouse the consumer's desire to purchase.

While the embodiments of the present invention have been set forth for the purpose of disclosure, modifications of the disclosed embodiments of the present invention as well as other embodiments thereof may occur to those skilled in the art. Accordingly, the appended claims are intended to cover all embodiments, which do not depart from the spirit and scope of the present invention.

What is claimed is:

1. A frameless diving mask, comprising:

at least one lens;

an adhesive, coated on an edge of the lens;

a first flexible layer, covering the edge of the lens and adhered to the edge of the lens by the adhesive, wherein the thickness of the first flexible layer is greater than that of the lens; and a second flexible layer, molded on the first flexible layer, wherein the second flexible layer extends toward one side of the lens to form a facial mask part;

wherein the first flexible layer is located between the lens and the second flexible layer, the first flexible layer has a plurality of protrusions, the protrusions pass through the second flexible layer, and the protrusions are exposed out of the second flexible layer at least in a top portion of the second flexible layer.

2. The frameless diving mask of claim 1, wherein the color of the second flexible layer is different from that of the first flexible layer.

3. The frameless diving mask of claim 1, wherein the second flexible layer is transparent or opaque.

4. A frameless diving mask, comprising:

two lens;

an adhesive, coated on edges of the lenses;

a first flexible layer, covering the edges of the lenses and adhered to the edges of the lenses by the adhesive, wherein the thickness of the first flexible layer is greater than that of the lenses; and a second flexible layer, molded on the first flexible layer, wherein the second flexible layer extends toward one side of the lenses to form a facial mask part; and a lens holder mounted between the lenses;

wherein the first flexible layer is located between the lenses and the second flexible layer, the first flexible layer has a plurality of protrusions, the protrusions pass through the second flexible layer, and the protrusions are exposed out of the second flexible layer at least in a top portion of the second flexible layer.

5. The frameless diving mask of claim 4, wherein the adhesive is coated on the edges of the lenses and the lens holder, wherein the first flexible layer covers the edges of the lenses and the lens holder and is adhered to the edges of the lenses and the lens holder by the adhesive.

* * * * *